United States Patent [19]

Flagg

[11] 4,377,153

[45] Mar. 22, 1983

[54] HEATING DEVICE

[76] Inventor: Rodger H. Flagg, 1415 Lynn Ave., Ft. Wayne, Ind. 46805

[21] Appl. No.: 250,008

[22] Filed: Apr. 1, 1981

[51] Int. Cl.[3] ..... F23L 13/00

[52] U.S. Cl. ..... 126/285 R; 126/77; 126/61; 126/126; 126/136

[58] Field of Search ..... 126/99 D, 110 A, 108, 126/126, 136, 123, 61, 60, 66, 65, 67, 285 R, 285 A, 296, 297, 77; 110/147, 163

[56] References Cited

U.S. PATENT DOCUMENTS

| | | | |
|---|---|---|---|
| 138,093 | 4/1873 | Littlefield | 126/289 |
| 390,119 | 9/1888 | Evans | 126/296 |
| 507,093 | 10/1893 | Alger | 126/61 |

FOREIGN PATENT DOCUMENTS

| | | | |
|---|---|---|---|
| 242485 | 2/1961 | Australia | 126/123 |

*Primary Examiner*—Samuel Scott
*Assistant Examiner*—G. Anderson
*Attorney, Agent, or Firm*—Rodger H. Flagg

[57] ABSTRACT

A heating device for consuming a combustionable fuel, having an internal combustion chamber with top, sides, ends, and a grate forming the bottom; an outer shell, having a top, sides, ends, and a bottom in spaced relation below the grate; a primary air supply adapted to distribute the air beneath the grate; a secondary air supply adapted to preheat the secondary air prior to entering the combustion chamber at a location above the grate; an axis door in one end suitable to pass fuel within the combustion chamber; an exhaust chamber between the combustion chamber and the outer shell adapted to extend across the top and at least partially down a side in fluid communication with the combustion chamber; an exhaust port adapted to exhaust the combustion gases from the exhaust chamber externally of the device; a damper adapted to selectively divert exhausting gases in the exhaust chamber at least partially down one side, to extend the distance travelled by the exhausting gases to improve secondary combustion and thermal heat transfer prior to exiting the exhaust gases from the device. A plurality of baffles adapted to extend at least partially down a side of the exhaust chamber and adapted to serpentine the exhausting gases through an extended path within the exhaust chamber when the damper is closed.

21 Claims, 9 Drawing Figures

FIG. 3
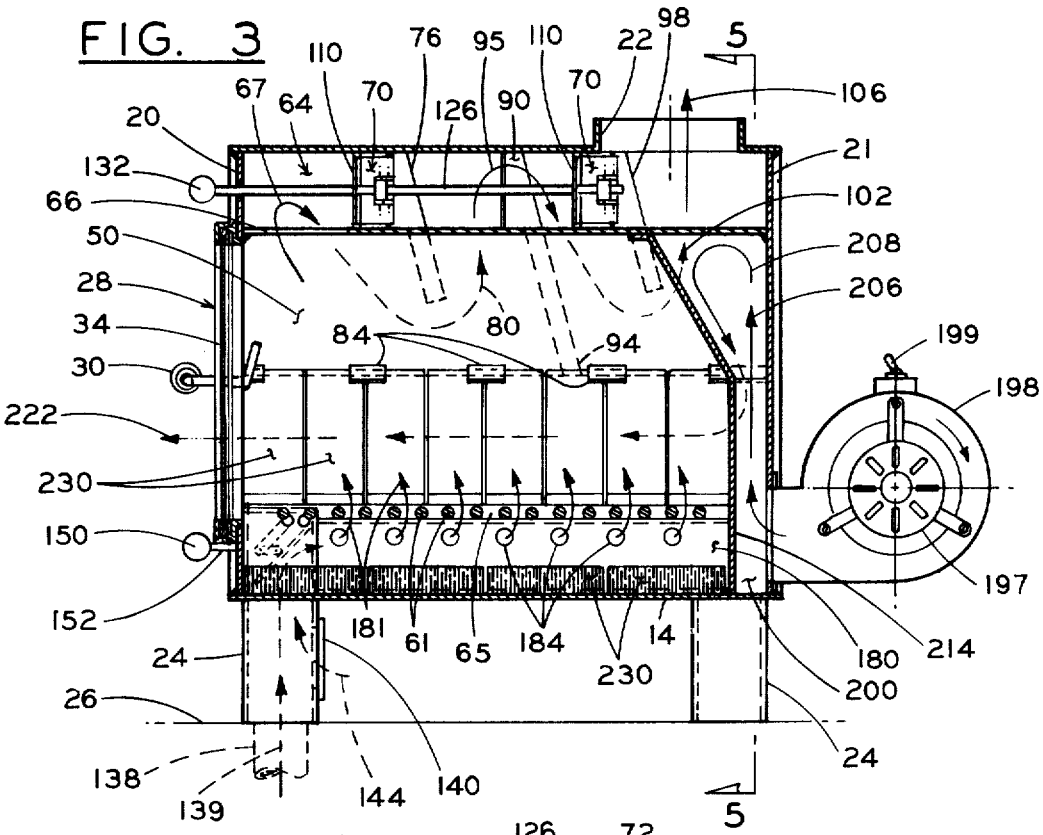
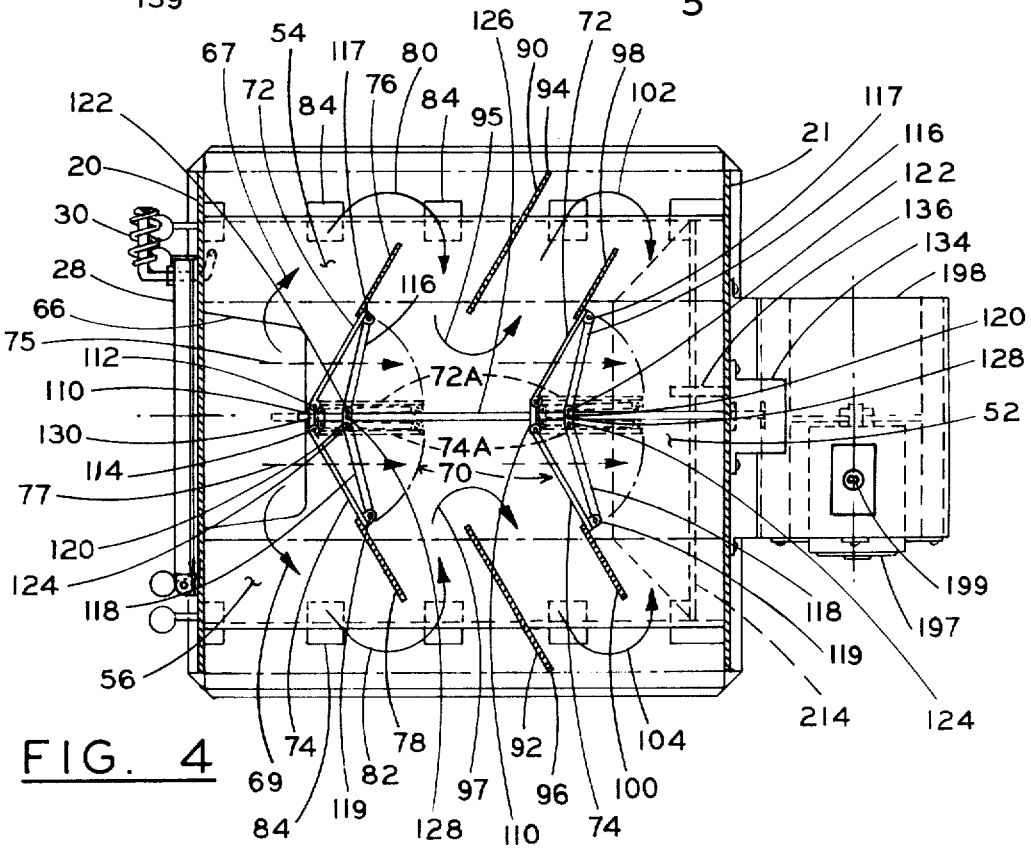
FIG. 4

HEATING DEVICE

BACKGROUND OF THE INVENTION

1. Field of the Invention

This invention relates generally to heating devices adapted to burn a combustionable fuel; more specifically to a free-standing heating device having an internal combustion chamber and an outer shell adapted to surround the combustion chamber in spaced relation to form an exhaust chamber extending along the top and at least a portion of a side between the combustion chamber and the outer shell; said exhaust chamber adapted to receive exhaust gasses from the combustion chamber and to exhaust these gasses externally of this device to atmosphere, wherein a plurality of baffles and a damper are adapted to selectively increase the distance the exhaust gasses travel, at least partially down the sides of the combustion chamber between the baffles prior to exiting from the device to allow more complete secondary combustion and to improve heat transfer.

2. Description of the Prior Art

Heating devices have recently made significant gains over the traditional efficiency of the open hearth fireplace. These gains are due in large part to the improved combustion efficiency caused by employing firebrick in proximity to the fire to increase and retain combustion temperatures; preheating the secondary air for improved secondary combustion of exhausting gasses; supplying outside inlet air for improved combustion efficiency; providing a blower to actively pass room air through the heating device into the room; and by increasing the distance exhaust gasses travel prior to exiting the device, as employed in Scandinavian arches or secondary combustion chambers, for improved heat transfer.

Modern stoves or other heating devices often have one or more of these features, but to the best of my knowledge, no prior heating device has disclosed a heating device adapted to combine all of these distinct features in a novel way into a single heating device. Nor have any of the known prior art shown how to selectively extend the exhausting gasses across the top and partially down a side of the exhaust chamber to selectively increase the distance travelled for improved heat transfer, nor to provide for the recirculation of heavier exhausting gasses from the exhaust chamber back into the combustion chamber for more complete combustion.

Therefore, one object is to develop an improved heating device.

Another object is to provide an exhaust chamber extending across the top and at least partially down the side of the combustion chamber to selectively increase the distance travelled by the exhausting gasses prior to exhausting these gasses from the device.

Another object is to provide a plurality of baffles extending at least partially down the side of the exhaust chamber.

Yet another object is to provide a damper control to selectively route the exhausting gasses along the baffles within the exhaust chamber to extend the distance exhausting gasses travel prior to exiting from the device.

Still another object is to provide an exhaust return passage in relation to the lower portion of the exhaust chamber in fluid communication with the combustion chamber to pass heavier combustion gasses back into the combustion chamber for more complete combustion.

The above mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 3 is a cross-sectional view taken along lines 3—3 in FIG. 1;

FIG. 4 is a top elevation view of the preferred embodiment shown in FIG. 1, wherein the top plate has been removed to show the exhaust chamber above the combustion chamber, and the damper is adapted to be thermostatically controlled;

DESCRIPTION OF THE PREFERRED EMBODIMENT

Figure 1:
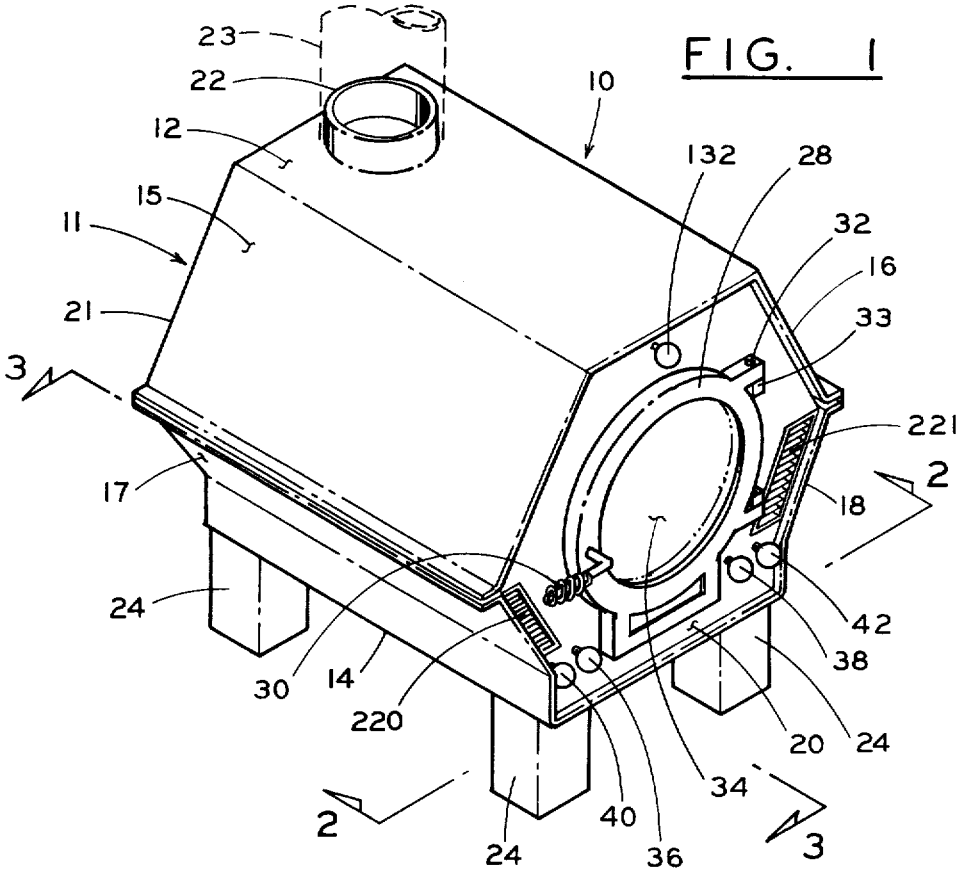
FIG. 1 is a perspective view of a preferred embodiment of the invention.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows the preferred embodiment of a heating device 10 having an outer shell 11 comprising a top 12, bottom 14, upper sides 15, 16, lower sides 17, 18, access end 20, discharge end 21, and exhaust port 22, adapted for securement to a flue pipe 23 extending to atmosphere. Heating device 10 is supported on a plurality of feet 24, adapted to allow room air to freely pass between the stove bottom 14 and supporting surface 26.

Access end 20 has an access door 28 of a size sufficient to conveniently place combustionable fuels, such as wood, coal, or the like 29, within heating device 10. Access door 28 has a handle 30 adapted to selectively secure access door 28 in closed relation, or to release access door 28 to pivot about pin 32 rotatably secured in brackets 33 to access end 20 to provide access within. Preferably, access door 28 has a transparent viewing insert 34, such as high temperature glass, suitable for viewing the fire within, during use. Access door 28 is preferably a generally circular configuration.

Figure 2:
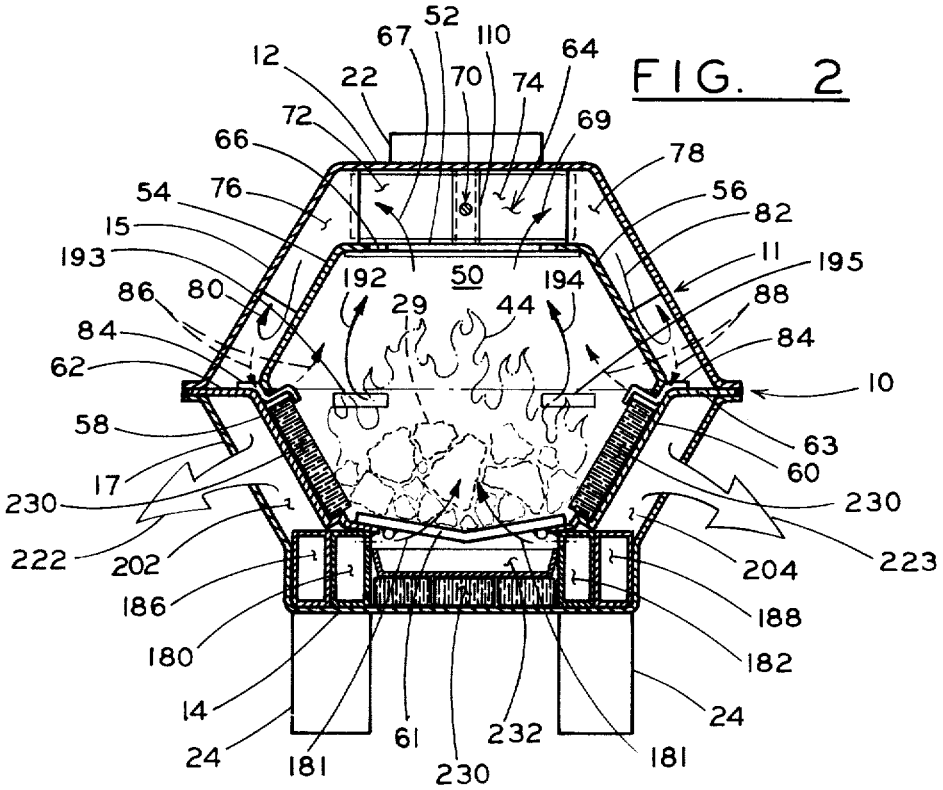
FIG. 2 is a cross-sectional view taken along lines 2—2 in FIG. 1.

Primary draft controls 36, 38, and secondary draft controls 40, 42 serve to control the volume of the air entering the device 10, and may be adapted to be tightly sealed, to restrict air passage within, for safety should an uncontrolled fire 44 occur within device 10, or in flue pipe 23. As shown in FIG. 2, a combustion chamber 50 is provided in spaced relation within outer shell 11, to contain fire 44. Combustion chamber 50 is preferably formed with an upper surface 52, upper depending sides 54, 56, lower sides 58, 60, and grate 61.

In the preferred embodiment, as shown in FIG. 2, lower sides 58, 60 of chamber 50 are adapted to extend to be secured to outer shell 11 about midsection, to isolate exhaust chamber 64 above extended ends 62, 63 of lower sides 58, 60. Exhaust chamber 64 is adapted to receive exhaust gasses from combustion chamber 50 through aperture 66 as shown by arrows 67, 69, and to exhaust these gasses through exhaust port 22. Damper assembly 70 is adapted to selectively route exhaust gasses directly from aperture 66 to exhaust port 22 when damper gates 72, 74 are opened into near parallel alignment as shown by dashed arrows 75, 77 in FIG. 4, or adapted to divert exhaust gasses within upper exhaust chamber 64 along baffle plates 76, 78 partially down the sides of device 10 as shown by arrows 80, 82 when damper gates 72, 74 are extended to abut baffles 76, 78.

As shown in FIG. 2, optional spacers 84 may be adapted to be interposed in spaced relation between upper depending sides 54, 56 and lower sides 58, 60 to provide a narrow intermittent exhaust return passage for heavier exhaust gasses to pass from the lower end of the exhaust chamber 64 to the combustion chamber 50 for more complete burning, as shown by dashed arrows 86, 88. Where recirculation of heavier exhaust gasses is not desired, sides 54, 56 may readily be sealingly joined to lower walls 58, 60.

As shown in FIGS. 3 and 4, more than one pair of baffles 76, 78 may be adapted to serpentine exhausting gasses partially down sides of device 10 within exhaust chamber 64. Where more than one pair of baffles 66, 78 are used, it is preferable to alternately extend baffles 90, 92 to restrict passage of exhaust gasses past lower ends 94, 96 causing exhaust gasses to alternately descend and rise between baffles 76, 78 and baffles 90, 92 as shown by arrows 80, 82.

Arrows 95, 97 show a continuing serpentine action of exhaust gasses between baffles 90, 92 and baffles 98, 100 as shown by arrows 102, 104 to exhaust gasses through exhaust port 22 as shown by arrow 106. Where more than two pairs of baffles are used, additional damper assemblies 70 may also be used. Preferably, baffles 76, 78; 90, 92; and 98, 100 are inclined in the direction of the downward travel of the exhaust gasses through exhaust chamber 64 to improve airflow characteristics.

Damper assembly 70 is adapted with damper gates 72, 74 pivotally secured at one end to a central column 110 by pins 112, 114. Opposing ends of damper gates 72, 74 are adapted to pivotally secure one end of link arms 116, 118 by pins 117, 119. Opposing ends of link arms 116, 118 are adapted to be pivotally secured to positioning link 120 by pins 122, 124. Positioning link 120 is adapted to be secured to positioning rods 126 by set screw 128 or other conventional fastening means. Rod 126 is adapted to pass through column 110 through aperture 130. Positioning rod 126 is adapted to extend beyond exhaust chamber 64 through access end 20 for securement to handle 132 for manual control; or may be adapted to extend from exhaust chamber 64 through discharge end 22 for automatic positioning by thermostatic control 134. Thermostatic control 134 has a temperature sensing probe 136 adapted to be positioned in upper exhaust chamber 64, exhaust port 22, or flue 23 and is further adapted to be responsive to a selected temperature range.

Positioning link 120 is secured to rod 126 so that when gates 72, 74 abut baffles 76, 78, link 120 is spaced apart from central column 110; and when gates 72, 74 are pivoted into near parallel alignment as shown by dashed lines 72A, 74A in FIG. 4, link 120 is moved closer to column 110, to effect the desired movement of gates 72, 74. Link arms 116, 118 are adapted with a shorter pivoting radius than gates 72, 74. Less than two inches of lateral movement of handle 132 is required to selectively position gates 72, 74 from near parallel open alignment to 120° closed alignment. Movement of rod 126 may be readily adapted for sliding movement, as previously discussed, or threadably engaged for rotational movement.

Where rotational threaded movement is preferred, link 120 is adapted to be positioned in relation to column 110 by the rotating movement of rod 126. Rod 126 may threadably engage end 20 or 22; or column 110; or link 120, to effect movement of gates 72, 74 as previously disclosed. Where rod 126 is adapted to threadably engage link 120, rotational movement of rod 126 will not result in lateral movement of handle 132. Link 120 and column 110 may be adapted to be interposed without affecting movement of damper assembly 70.

Figure 7:
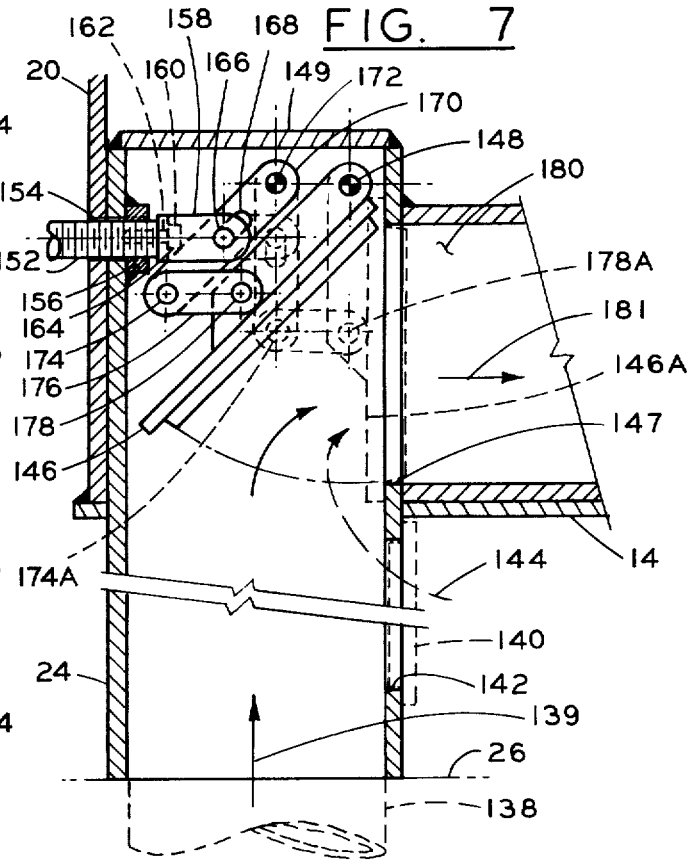
FIG. 7 is a cross-sectional view of the preferred primary and secondary gate control.

As shown in FIG. 7, primary and secondary air is preferably adapted to enter device 10 through leg 24. Where desired, external air from atmosphere may be supplied in fluid communication with legs 24 through supporting surface 26 by a pipe 138 at installation as shown by arrow 139. Where it is not practical, or desired to provide external air from atmosphere, cover 140 may be removed, to allow room air to pass into front leg 24 through aperture 142 as shown by dashed arrow 144.

Primary and secondary air is controllably supplied within combustion chamber 50 by individual gates 146, adapted to be pivotally secured within leg 24 by pin 148 in sealing relation to gate aperture 147, when closed; and responsive to movement of its associated primary or secondary draft control 36, 38 or 40, 42. The upper end of leg 24 is sealed by plate 149 to contain air within legs 24.

Preferably, each draft control has a handle 150 secured to a threaded extension 152 adapted to pass through aperture 154 in leg 24, and threadably engaging nut 156 secured in relation to aperture 154 to nonrotatably bias end bracket 158. This may be accomplished by securing a screw 160 through closely aligned aperture 162 in end bracket 158 into the end of threaded extension 152 so that screw 160 may freely rotate with extension 152, while the enlarged screw head 164 biases end bracket 158 in relation to the biasing movement of extension 152, or by other conventional means. Bracket 158 is further adapted to secure pin 166 in position to slidably engage slot 168 in link 170. Link 170 is pivotally secured to leg 24 by pin 172, and is adapted to extend pass bracket 158 to rotatably enage pin 174. Pin 174 is adapted to be secured to link 176, whose opposite end is adapted to secure pin 178, which is adapted to rotatably engage gate 146 about its centerline.

Thus, as handle 150 is rotated, end bracket 158 is non-rotatably biased acting through pin 166 to bias link 170 about pin 172, which acts through pin 174 to bias link 176, which in turn acts through pin 178 to bias gate 146 about pin 148 in relation to gate aperture 147. While end bracket 158 may be adapted to directly link to gate 146, the linkage disclosed is preferred, as fewer rotations of handle 150 are required to bias gate 146 from solid line position to dashed line position 146A shown in FIG. 7 for a given thread pitch, while the resultant effort is displaced near the centerline of gate 146 for improved sealing when gate 146 is closed.

As shown in FIG. 3, primary air control 36 or 38 is adapted as previously disclosed to bias its associated gate 146 to controllably supply incoming air into an extended horizontally disposed tubular aperture 180 or 182, which is adapted to exit from tubular aperture 180 or 182 through spaced apertures 184 located beneath grate 61 as shown by arrows 181. Apertures 184 may be sized to more evenly distribute primary air beneath the combustion chamber 50 for more uniform burning.

Figure 5:
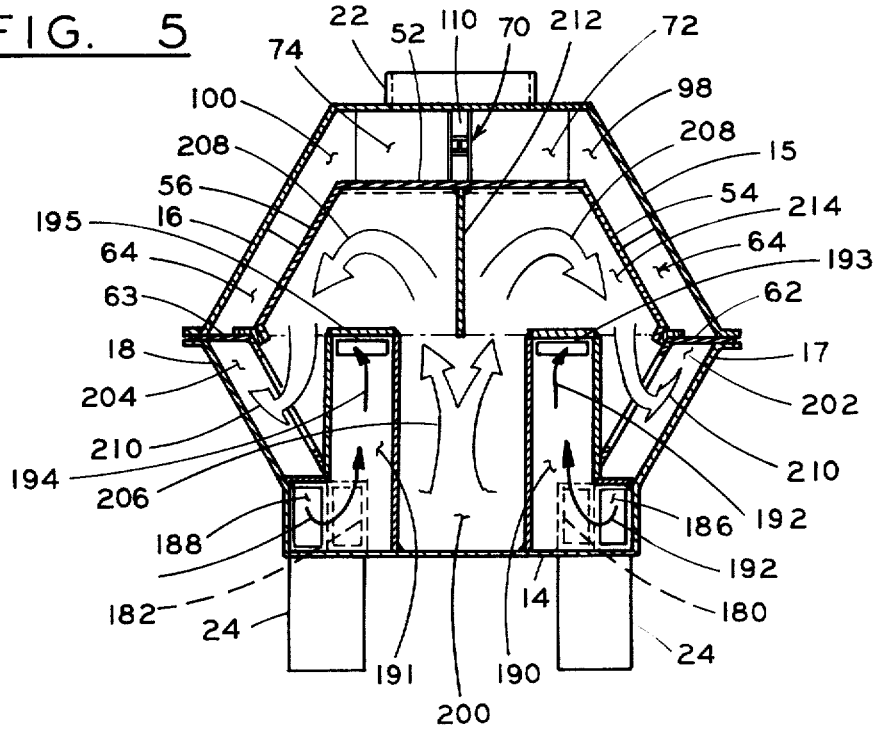
FIG. 5 is a cross-sectional view taken along lines 5—5 in FIG. 3.

Secondary air control 40, 42 is adapted as disclosed to bias its associated gate 146 to controllably supply incoming air into a horizontally disposed tubular aperture 186 or 188 which is adapted to extend substantially the length of device 10, and to exit into combustion chamber 50 through a vertically disposed secondary inlet chamber 190, 191 near the discharge end 22 above grate 61, through apertures 193, 195 as shown by arrows 192, 194 in FIG. 5. The distance travelled by the secondary air prior to entering the combustion chamber 50 serves to preheat the incoming air for improved secondary combustion, while allowing the secondary air control to be conveniently placed in association with primary inlet controls at the access end 20 of device 10.

A blower 198 may be adapted with an electric motor 197 and associated control switch 199 to actively disperse room air into a heating chamber 200 vertically disposed near the discharge end, and adapted to exhaust the air from heating chamber 200 through lower fluid passages 202, 204 as shown by arrows 206, 208, 210. Preferably, chamber 200 is adapted with a baffle 212 to divide and direct the passing air above the vertically disposed secondary inlet chamber 190, 191 into lower fluid passages 202, 204, respectively. Combustion chamber 50 is spaced from discharge end 22 by end plate 214, which may be inclined near the top as shown in FIG. 3 to improve internal airflow, and is sealed to protect against combustion gasses from combustion chamber 50 mixing with room air passing through heating chamber 200.

As shown in FIG. 1, air exiting from lower fluid passages 202, 204 may be directed through louvers 220, 221 adapted to adjustably direct the heated air into the room, for occupant comfort, as shown by arrows 222, 223 in FIG. 2.

Blower 198 motor 197 may be remotely actuated by switch 199, or thermostatically controlled to actuate when a combustionable fuel is being consumed within device 10. Preferably, blower 198 will be sized to move from seventy-five to two thousand cubic feet per minute into chamber 200, and may be adapted to operate at more than one selected rotational blower speed.

To maintain higher combustion temperatures for improved fuel combustion, it is preferred to position furnace brick 230 along the lower side 58, 60 within combustion chamber 50 above grate 61. Additional firebrick 230 may also be placed beneath grate 61 supported by bottom 14 to increase combustion temperatures within chamber 50.

An ash pan 232 may be adapted to be positioned in spaced relation beneath grate 61 to collect ash passing through opening 65 in grate 61, for ease of maintenance. Ash pan 232 may rest on bottom 14, or upon firebrick 230 positioned on bottom 14, where firebrick is adapted to be used at this location.

Grate 61 is preferably inclined from five to forty-five degrees away from the center of the combustion chamber 50 to tend to center combustionable fuel 29 thereon, and to improve air flow characteristics of air passing from primary apertures 184 through grate 61 into combustion chamber 50. Grate 61 may be adapted to be supported upon horizontally disposed tubular aperture 180, 182 or may be supported by ends 57, 59 of lower sides 58, 60.

Access door 28 may be adapted as shown in FIG. 1, to extend below grate 61 to provide access to ash pan 232. Where desired, a separate access door (not shown) may be conventionally adapted to provide access to ash pan 232, independent of access door 28.

Figure 6:
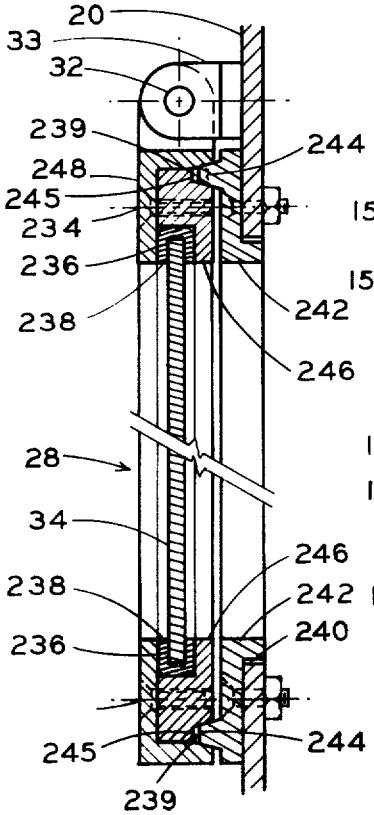
FIG. 6 is a cross-sectional view of the preferred access port construction.

Preferably, as shown in FIG. 6, access door 28 is sealingly closed to inhibit room air from being drawn through door 28 into combustion chamber 50. Access opening 240 may be adapted to receive a wall member 242 having an extension 244 adapted to surround opening 240. Door 28 may have a complementary groove 245 adapted to align with extension 244, when door 28 is closed. For ease of fabrication, door 28 may be formed of an internal member 246, 248, respectively, which may be secured by screws 234, or other conventional means. Transparent viewing insert 34 may be secured within groove 236 by internal seal 238, to insulate insert 34 and allow for expansion and contraction.

The complementary groove 245 may be adapted to retain furnace caulk 239 to improve sealing characteristics. Of course, extension 244 and complementary groove 245 may be reversed without affecting sealing chacteristics. Where access end 20 is fabricated of cast iron, wall member 242 is not needed, as extension 244 or groove 245 may be readily cast into access end 20.

While the preferred embodiment, as disclosed, is a free-standing heating device of welded steel construction, it is well within the talents of one skilled in this art to adapt the novelties of this invention to other applications such as fireplace inserts, oval, rectangular, square, or circular stove configurations, cast iron construction, or the like.

Figure 8:
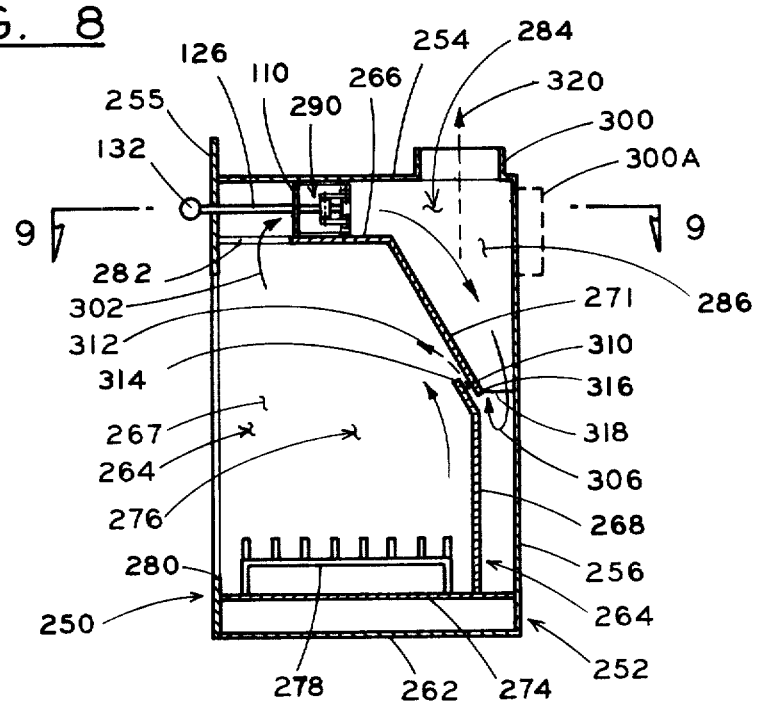
FIG. 8 is a cross-sectional side elevation view of a fireplace adapted to selectively route exhausting gasses along baffles to selectively extend the path the exhausting gasses travel within the exhaust chamber, prior to exiting from the device.
Figure 9:
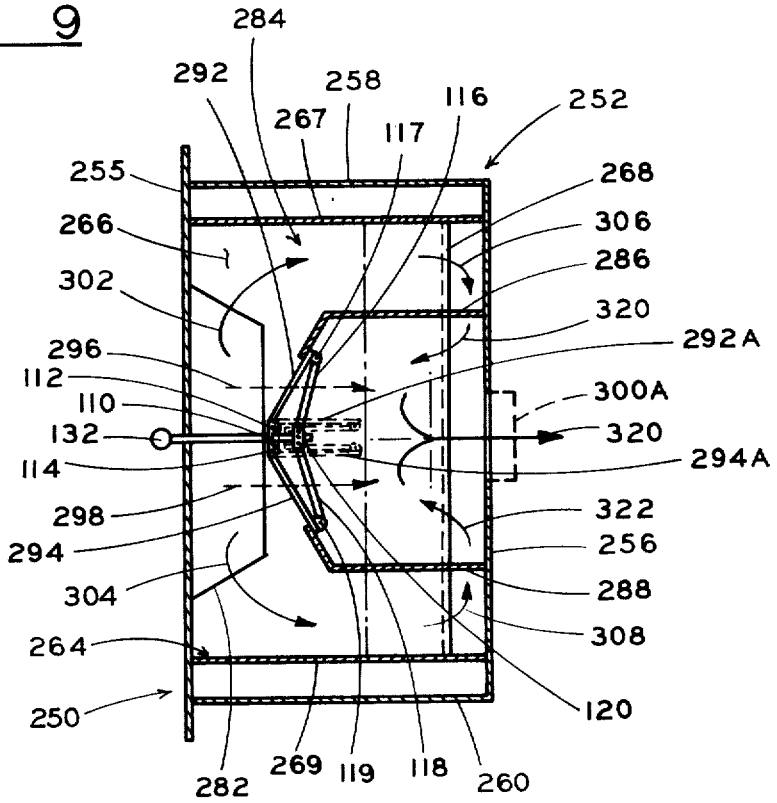
FIG. 9 is a top cross-sectional view of the fireplace, taken along lines 9—9 of FIG. 8.

For example, FIGS. 8 and 9, show a fireplace insert 250, adapted with an outer shell 252, having a top 254, sides 255, 256, 258, 260 and a bottom 262. Inner shell 264 has a top 266, depending sides 267, 268, 269 and bottom 274, forming a combustion chamber 276 therebetween. A grate 278 is adapted to be positioned on bottom 274, to support the combustionable fuel thereon.

Access aperture 280 is adapted to provide suitable access through side 255 into combustion chamber 276. The upper portion 271 of wall 268 is inclined to direct combustion gasses toward opening 282 in the top 266 of inner shell 264 to provide fluid communication between combustion chamber 276 and the exhaust chamber 284, located between inner and outer shells 264, 252. Exhaust chamber 284 is adapted to extend substantially across the top 266 of combustion chamber 276, and is further adapted to extend at least partially down sides 256, 268.

Baffles 286, 288 are adapted to extend between inner and outer shells within exhaust chamber 284, and to extend at least partially down sides 256, 286.

Damper control 290 is adapted to be adjustably positioned as previously disclosed, from near parallel open position as shown by dashed lines 292A, 294A to extended closed solid line position 292, 294. When damper 290 is opened, exhaust gasses from combustion chamber 276 pass through aperture 282 as shown by dashed arrows 296, 298 directly through exhaust chamber 284 to exhaust port 300. Exhaust port 300 may be vertically disposed, or may be adapted to be horizontally disposed as shown in dashed line 300A, to suit installation.

When damper control 290 is extended to closed position, the ends of gates 292, 294 align with baffles 286, 288 diverting exhaust gasses from combustion chamber 276 through aperture 282 along baffles 286, 288 as shown by arrows 302, 304. The exhausting gasses are directed along baffles 286, 288 partially down sides 256, 268 of exhaust chamber 284 as shown by arrows 306, 308.

Where desired, heavier exhaust gasses may be permitted to re-enter combustion chamber 276 through exhaust return passage 310 as shown by arrows 312. Preferably, the exhaust return passage 310 is inclined, with the combustion chamber end 314 higher than the exhaust chamber end 316, to provide for the return of heavier exhaust gasses to the combustion chamber 276, while limiting the passage of rising combustion gasses within the combustion chamber 276 from passing through the exhaust return passage 310 directly into the exhaust chamber 284.

The exhaust gasses directed along baffles 286, 288 as shown by arrows 306, 308 pass beneath the lower end 318 of baffles 286, 288, and rise by natural convection through exhaust port 300 as shown by arrows 320, 322. Thus, the path of exhausting gasses within exhaust chamber 284 may be readily extended by manual or remotely controlled damper 290 to significantly increase the distance travelled, prior to exiting from the heating device, for more complete combustion and improved heat transfer.

The extension of the exhaust chamber partially down a side provides for gravitational separation of heavier, combustion gasses passing along the lower end 318 of baffles 286, 288, to delay their passage from fireplace insert 250 through exhaust port 300. Preferably, such gasses are drawn through an exhaust return passage 310 back into the combustion chamber 276 for more complete combustion.

Therefore, while the invention has been described with reference to a particular embodiment, it is to be understood that modifications may be made without departing from the spirit of the invention or from the scope of the following claims.

What is claimed is:

1. A heating device adapted to burn a combustionable fuel in a room, which comprises:

an outer shell having a top, a bottom, and depending sides therebetween;

an inner shell having a top and depending sides, said inner shell adapted to be installed within said outer shell in spaced relation to provide an exhaust chamber therebetween extending across the top and at least partially down a side between said inner and outer shells;

an access aperture through a side of the heating device of a size sufficient to allow placement of a combustionable fuel within said inner shell;

a grate with a plurality of apertures therethrough adapted to substantially extend in spaced relation above the bottom of said outer shell to receive said fuel thereon, forming a combustion chamber between said grate and said inner shell, a portion of the top of said combustion chamber adapted to be in fluid communication with said exhaust chamber;

an exhaust port adapted to exhaust combustion gasses from the exhaust chamber through the exhaust port beyond the heating device into a suitable fluid duct to atmosphere;

a baffle in said exhaust chamber between the inner and outer shells, said baffle adapted to extend partially down a side in spaced relation between said inner and outer shells;

a damper positioned within the exhaust chamber and adapted to be adjustably positioned to provide through passage of combustion gasses from the combustion chamber through the exhaust chamber to the exhaust port; said damper adapted to be adjustably positioned to substantially divert combustion gasses in the exhaust chamber downwardly along said baffle within the exhaust chamber to extend the distance travelled by the combustion gasses prior to exiting from the exhaust chamber through the exhaust port.

2. The apparatus as claimed in claim 1, wherein an exhaust return passage is provided between the lower side portion of the exhaust chamber and the combustion chamber, and adapted to recirculate heavier exhaust gasses back into the combustion chamber for more complete burning prior to exhausting said gasses from the device.

3. The apparatus as claimed in claim 2, wherein the exhaust return passage between the lower portion of the exhaust chamber and the combustion chamber is adapted to be inclined, with the combustion end positioned higher than the exhaust end to provide for the return of heavier exhaust gasses to the combustion chamber, while limiting the passage of rising combustion gasses within the combustion chamber from passing through the exhaust return passage directly into the exhaust chamber.

4. The apparatus of claim 1, wherein a primary air inlet is adapted to controllably supply a variable volume of air into the heating device beneath said grate.

5. The apparatus of claim 1, wherein the side access aperture is adapted to sealingly receive an access door adapted to open for access to the combustion chamber, and to close to sealingly secure the side access aperture for improved combustion efficiency.

6. The apparatus of claim 1, wherein an ashpan is adapted to be positioned in spaced relation beneath said grate above the bottom of the outer shell to receive ashes from the combustionable fuel through apertures in the grate, said ashpan adapted for removal from the apparatus for ease of ash disposal.

7. The apparatus of claim 6, wherein the access door is adapted to extend below the level of said grate to additionally provide access to said ashpan located beneath said grate, when said access door is opened.

8. The apparatus of claim 1, wherein a plurality of legs are adapted to support the heating device in spaced relation from the floor to provide air passage between the bottom of the outer shell and the room floor.

9. The apparatus of claim 8, wherein inlet air is supplied from atmosphere to the heating device through a suitable fluid duct into at least one of said legs, said leg adapted to be in fluid communication with an inlet gate control, said inlet gate control adapted to be selectively biased by a gate control handle extending through the access side of the device, and further adapted to sealingly secure the inlet air against entry into the device when closed, and to be selectively positioned to provide a variable volume of inlet air into the device to control the rate of combustion therein, when selectively open.

10. The apparatus of claim 1, wherein a secondary air inlet is adapted to controllably supply a variable volume of air into the heating device through a fluid passage extending within the heating device a length sufficient to suitably preheat the air passing therethrough, said fluid passage adapted to discharge the preheated air into the combustion chamber at a location above said grate.

11. The apparatus of claim 10, wherein said secondary air inlet is adapted to pass inlet air from near the access side along a fluid duct horizontally disposed substantially along a side of the inner shell, to heat the secondary air prior to said secondary air exiting from said duct into said combustion chamber above the grate.

12. The apparatus of claim 5, wherein said access door is adapted to insulatingly secure a high temperature transparent viewing port therein to provide visability into the combustion chamber when said access door is closed, and a combustionable fuel is being consumed.

13. The apparatus of claim 1, wherein the grate is adapted to incline away from the center of the combustion chamber to tend to center fuel thereon, and to improve air flow characteristics of the air passing beneath the grate.

14. The apparatus of claim 1, wherein the baffle in said lower portion of the exhaust chamber is adapted to incline in the direction of the downwardly moving exhausting gasses to improve airflow characteristics.

15. The apparatus of claim 1, wherein more than one baffle is secured in spaced relation at least partially along a depending side in the exhaust chamber between the inner and outer shells, said baffles adapted to be alternately shorter and longer to serpentine the exhausting gasses between the spaced apart alternating shorter and longer baffles within the exhaust chamber to increase the distance travelled by the exhausting gasses.

16. The apparatus of claim 1, wherein the damper comprises:

a vertically disposed column adapted to be positioned between the opposing walls of the exhaust chamber;

a pair of vertically disposed opposing damper gates pivotally secured at one end to the column and adapted to extend substantially the height of the exhaust chamber, and of a length sufficient to extend from the column to near the associated end of opposing baffles when the damper gates are extended toward closed position;

opposing link arms of a length shorter than the damper gates, one end of each link arm adapted to be pivotally secured near the opposite end of said damper gate;

a centrally disposed linkage pivot, adapted to pivotally secure the opposite end of the opposing link arm;

a rod extension, adapted to controllably position the link pivot in relation to the column in a manner to provide retraction of the opposing damper gates toward parallel alignment when the link pivot and the column are biased closer together, and movement of the opposing damper gates toward an extended relation when said link pivot and column are biased apart.

17. The apparatus of claim 16, wherein more than one damper is adapted to be in-line, and the rod extension is adapted to extend within the exhaust chamber to secure the in-line link pivot to provide conjoint operation of the dampers, as the rod extension is moved in relation to the column.

18. The apparatus of claim 1, wherein a pair of lower heat chambers are adapted to extend between said bottoms and the lower sides of the inner and outer shells; said lower chambers adapted to be in fluid communication with an electrically operated blower, wherein said blower is adapted to pass room air through said lower heat chambers to heat said room air, and the opposite ends of the lower heat chambers are adapted to exhaust the heated air externally of the device into the room.

19. The apparatus of claim 18, wherein the electrically actuated blower is adapted to be selectively actuated by a thermostat control having a temperature probe adapted to actuate the blower, when the temperature in the vicinity of the probe rises above a selected temperature range.

20. The apparatus of claim 1, wherein firebrick is adapted to be positioned within the combustion chamber above said grate along said sides to retain heat and increase combustion temperatures in the vicinity of said grate to improve combustion and to minimize the danger of burnout to the lower sides of the inner shell.

21. The apparatus of claim 1, wherein firebrick is adapted to be horizontally disposed in spaced relation beneath said grate to retain heat and increase temperatures in the combustion chamber, and to minimize the danger of burnout to the base of the outer shell.

* * * * *